United States Patent [19]

Chave

[11] Patent Number: 4,461,933

[45] Date of Patent: Jul. 24, 1984

[54] ELECTRICAL/MECHANICAL TRANSDUCERS

[76] Inventor: Donald M. Chave, The Granary, Jackass La., Keston, Kent, England, BR2 6AN

[21] Appl. No.: 215,375

[22] Filed: Dec. 11, 1980

[30] Foreign Application Priority Data

Dec. 12, 1979 [GB] United Kingdom ..... 7942880

[51] Int. Cl.[3] ..... H04R 9/04

[52] U.S. Cl. ..... 179/115.5 VC; 179/115.5 R

[58] Field of Search ..... 179/115.5 R, 115.5 VC, 179/115.5 PC, 115.5 ME, 119 R, 180, 115 R–115 V, 181 R–181 W

[56] References Cited

U.S. PATENT DOCUMENTS 2,538,691 1/1951 Kim ..... 179/115.5 VC 4,088,847 5/1978 Yukimoto et al. ..... 179/115.5 VC

*Primary Examiner*—Benjamin R. Fuller

*Attorney, Agent, or Firm*—Kemon & Estabrook

[57] ABSTRACT

A speech coil 3 in for example a moving-coil type loudspeaker includes a layer of magnetizable material 1 such as plastics tape impregnated with ferric oxide. The tape is wound on to a former 2 and moves with the coil to provide magnetic damping to more accurately center the coil and reduce overshoot of the coil in response to current peaks.

3 Claims, 1 Drawing Figure

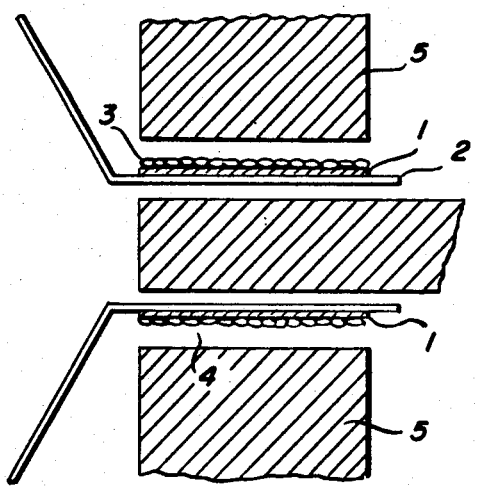
5
3
1
2
1
4
5

ELECTRICAL/MECHANICAL TRANSDUCERS

DESCRIPTION

This invention relates to electrical/mechanical transducers such as loudspeakers where an electrical signal is converted to a mechanical one and microphones where the reverse happens. The invention relates in particular to an electrical coil for driving or being driven by, as the case may be, the diaphragm of such a transducer.

In a loudspeaker, the force, in dynes, developed by the interaction of the current in the speech coil and the magnetic field is represented, when the field surrounding the whole length of the speech coil is uniform, by the equation:

$$f = Bli \quad (1)$$

where B is the flux density, in gauss;

l is the length of the speech coil conductor, in centimeters, and i is the current in amperes.

If the field is not uniform over the whole length of the coil, equation (1) is replaced by the following:

$$f = \int i\, B.dl \quad (2)$$

where B.dl is the product of the field surrounding an element of length dl and the length dl itself, and the integral is to be taken over the whole length of the coil.

The above equations express the fact that the force is equal to the product of flux density and length, averaged over the length of the coil, multiplied by the current.

In a loudspeaker designed for a specific purpose, such as to meet a specific market requirement, the available flux density is restricted by cost, and the resistance of the coil is defined. The designer then endeavours to obtain the maximum force with a given value of current. Within such constraints the average value of the term B.dl is required to be made as large as possible.

The number of turns in the coil is made as large as possible and the coil has an axial length sometimes extending beyond the axial length of the magnet. When the loudspeaker responds to a large current at low frequency the coil moves appreciably and part of the coil moves outside the uniform magnetic field resulting in harmonic distortion and cross-modulation. It is important to ensure that such excursions are controlled. However, it is difficult to mechanically damp this movement of the coil without seriously affecting the fidelity of the loudspeaker, and so many speakers suffer from pendulum type oscillations of the coil when the coil is subject to large currents. Apart from the fact that when oscillating in this manner the coil is not following the signal current, the pendulum oscillations may cause successive current pulses to be ineffective particularly when a complex frequency signal occurs. Unless these pendulum oscillations are reduced modulation of the high order frequency content of the true signal by the lower frequencies of the same signal will occur. Similar intermodulation distortion occurs in a sensitive microphone when a loud sound is received.

It is an object of this invention to provide an electrical/mechanical transducer of the moving coil type in which the pendulum oscillations are reduced and the movement of the coil more closely follows the dictates of the driving signal.

According to the present invention there is provided an electrical/mechanical transducer of the moving coil type in which the coil includes or has in moving association with it, magnetisable material to provide magnetic damping to the coil.

The magnetisable material may take the form of plastic tape impregnated with a magnetic composition such as ferric oxide.

By means of this magnetic damping the speech coil is maintained more accurately centred in the magnetic gap thereby providing a high average efficiency, and overshoot of the coil caused by a peak in the input current in restricted. The reproduction of speech and music by the loudspeaker is therefore more clearly defined.

Some loudspeakers include centering devices for holding the coils accurately in the middle of the air gap between the pole pieces, the present invention may obviate the need for such devices or at least may reduce the controlling force required for such devices.

BRIEF DESCRIPTION OF THE DRAWING

In one embodiment of the invention, shown in the accompanying drawing, a layer of magnetisable material 1 such as iron foil or plastic tape impregnated with ferric oxide is wound on to a former 2. The coil 3 itself is then wound in the usual way over the layer 1.

The gap 4 between the pole pieces 5 through which the magnetic flux extends defines the limits of the axial length of the magnetisable layer 1 that are preferable.

Depending of the circumstances more or less magnetisable material may be required and the use of ferric oxide tape makes fine adjustment of the magnetic permeability possible. The material can be applied to a wound coil on any or all of its surfaces, and this technique can be applied to a coil that is 'edge wound' i.e., has no former. It will be appreciated that this invention has applicability to a number of types of loudspeakers, for example those with simple or complex diaphragm assemblies and those with extremely low-mass thin-film diaphragms. Furthermore the invention may be applied to other types of transducers such as moving-coil pen recorders and transcribers for cutting phonograph records, and as previously stated to mechanical-to-electrical transducers such as microphones.

I claim:

1. An electromechanical loudspeaker of the moving-coil type including magnetic pole pieces defining an air gap within which the coil is at least partially located, the coil having in moving association with it, magnetisable material operative to interact with the magnetic field produced by the said pole pieces to damp movement of the coil, and wherein when the coil is at rest said magnetisable material is located wholly within the axial extent of said air gap and symmetrically with respect to the axial limits thereof, and the coil occupies substantially the fill axial extent of the air gap.

2. A loudspeaker as claimed in claim 1 wherein the magnetisable material comprises plastics tape incorporating a magnetic composition.

3. A loudspeaker as claimed in claim 1 wherein said coil comprises a coil of wire wound around a former and said magnetisable material is included as a layer between the coil and the former.

* * * * *